US008834204B2

(12) United States Patent
De Bruijn et al.

(10) Patent No.: US 8,834,204 B2
(45) Date of Patent: Sep. 16, 2014

(54) CONNECTOR ASSEMBLY

(75) Inventors: Jeroen De Bruijn, SR Loon OP Zand (NL); Paul Johannes Marinus Potters, AG Eindhoven (NL); Ludwig Lange, CT Nuland (NL); Winnie Heyvaert, Wuustwezel (BE)

(73) Assignee: FCI, Guyancourt (FR)

( * ) Notice: Subject to any disclaimer, the term of this patent is extended or adjusted under 35 U.S.C. 154(b) by 80 days.

(21) Appl. No.: 13/376,005

(22) PCT Filed: Feb. 1, 2010

(86) PCT No.: PCT/IB2010/000612
§ 371 (c)(1),
(2), (4) Date: Jan. 23, 2012

(87) PCT Pub. No.: WO2010/140029
PCT Pub. Date: Dec. 9, 2010

(65) Prior Publication Data

US 2012/0129399 A1 May 24, 2012

Related U.S. Application Data

(60) Provisional application No. 61/184,268, filed on Jun. 4, 2009, provisional application No. 61/184,275, filed on Jun. 4, 2009.

(51) Int. Cl.
*H01R 13/658* (2011.01)

(52) U.S. Cl.
CPC ..... *H01R 13/65807* (2013.01)
USPC ..... 439/607.07

(58) Field of Classification Search
CPC ..... H01R 13/65807; H01R 23/7073; H01R 13/514; H01R 1313/506; H01R 9/2408
USPC ..... 439/607.07, 607.11, 701, 79, 717
See application file for complete search history.

(56) References Cited

U.S. PATENT DOCUMENTS 6,517,360 B1 * 2/2003 Cohen ..... 439/65
6,592,381 B2 * 7/2003 Cohen et al. ..... 439/80
7,195,519 B1 * 3/2007 McAlonis et al. ..... 439/607.39

(Continued)

FOREIGN PATENT DOCUMENTS

EP 0 924 812 A1 6/1999

*Primary Examiner* — Phuong Dinh
(74) *Attorney, Agent, or Firm* — Harrington & Smith

(57) ABSTRACT

A connector assembly is provided which includes a housing and at least one conductor module. The conductor module comprises at least a first sub-module and a second sub-module attached together to form the conductor module. The conductor module is at least partially received in the housing. The housing and the first sub-module include cooperating positioning structures for positioning the at least one conductor module into the housing such that the position of the second sub-module with respect to the housing is determined by the position of the first sub-module with respect to the housing in at least a first direction (X; Z). A connector assembly is also provided in which at least one contact includes at least one contact beam of which a part is resiliently displaceable substantially parallel to a side wall of the housing from a preload position to a second position for receiving a mating contact. The housing includes a stand-off structure configured to cooperate with at least a portion of the contact to provide and maintain a separation between at least the contact portion and the first side wall in and between the preload position and the second position.

18 Claims, 5 Drawing Sheets

(56) References Cited

U.S. PATENT DOCUMENTS

| | | | | |
|---|---|---|---|---|
| 2006/0166528 | A1 | 7/2006 | Hull et al. | 439/79 |
| 2007/0021001 | A1 | 1/2007 | Laurx et al. | |
| 2007/0099507 | A1 | 5/2007 | Ohnishi et al. | |
| 2008/0003890 | A1 | 1/2008 | Minich | |
| 2012/0202363 | A1* | 8/2012 | McNamara et al. | 439/74 |

* cited by examiner

CONNECTOR ASSEMBLY

CROSS REFERENCE TO RELATED APPLICATION

This application is a 371 of PCT/IB2010/000612 filed on Feb. 1, 2010, which claims the benefit of U.S. provisional application no. 61/184,268 filed Jun. 4, 2009 and U.S. provisional application no. 61/184,275 filed Jun. 4, 2009.

TECHNICAL FIELD

The present disclosure relates to the field of connector assemblies, in particular electrical connector assemblies, more in particular to modular connector assemblies.

BACKGROUND

Various modular connectors are known, wherein modules such as conductor modules, insulating modules and/or spacer modules are arranged in a housing, e.g. a header. Different connector assemblies may be formed by assembling different numbers and/or types of conductor modules into a housing or header. The modules may be arranged in a side-by-side relationship.

With the ever-increasing signalling speed required by present-day systems the signals transmitted over a conductor become more and more sensitive to coupling and/or cross talk with neighbouring conductors within one conductor module and between adjacent conductor modules. Such coupling and/or cross talk interaction between conductors is sensitive to the distance between the conductors. Thus, in order to accurately assess and/or control the amount and/or effect of such interaction on a particular conductor at one or more signal frequencies, the relative positions of the conductors are important.

Since there are continuing desires for smaller connectors, modular connector are desired which allow a compact build. Further concerns are cost reduction for materials and manufacturing.

SUMMARY

In a first aspect, the connector assembly of claim 1 is provided. The connector assembly is modular, facilitating assembly and adaptation of the connector assemblies for various specific desired configurations with respect to the number and arrangement of conductors. Providing conductors in an overmoulded lead frame assembly provides achieving and maintaining reliable positioning of the conductors within the sub-module. Forming a conductor module from a first and a second sub-module allows pre-assembling the conductor module and facilitates assembly of the connector assembly. In the connector assembly, the position of the second sub-module with respect to the housing is determined by the position of the first sub-module with respect to the housing in at least the first direction, preferably two directions, substantially perpendicular to the mating direction due to the cooperating positioning structures of the at least one conductor module and the housing. The reliability of the relative positions of the conductor module and the housing are determined by the tolerances of the first sub-module and the housing. Since the first and second sub-modules are attached together to form the conductor module, the relative position of the first and second sub-modules, and thus the relative positions of the conductors provided by the lead frame assemblies, are reliably and accurately established directly. Thus, the reliability of the relative positions of the conductors in the first and second sub-modules are determined by their proper tolerances. In the present connector assembly the relative position of the first and second sub-modules is independent of the tolerances of the housing. The present connector assembly thus allows better controlling and maintaining true positioning of the conductors within the conductor module and thus of the integrity of signals to be transmitted through or within it.

Another advantage is that the conductor module as a whole may be more robust than an individual sub-module, so that assembly of the connector assembly is facilitated. Positioning structures of the housing for positioning the conductor module(s) may be further apart and thus formed larger and more robust than when required for each single overmoulded lead frame assembly. As a consequence, the housing and a mould therefore may be manufactured more economically.

Advantageously, the cooperating positioning structures of the at least one conductor module and the housing are formed such that contact and/or interference between the second sub-assembly and the housing are substantially prevented. The connector assembly of claim 2 facilitates such prevention.

The connector assembly of claim 3 provides reliable alignment of the conductor module relative to the housing in the first direction since competition between different alignment surfaces in the first direction is prevented.

The connector assembly of claim 4 further improves reliability of the alignment of the conductor module relative to the housing by preventing competition between different alignment surfaces in a second direction as well.

In the connector assembly of claim 5 plural conductor modules are all aligned to the housing towards the same direction, such that tolerances all work in the same direction and reliability of the positioning of the conductor modules and thus of the conductors therein is improved. Advantageously, each of said plurality of conductor modules also comprises second cooperating positioning structures as defined in claim 4.

In the connector assembly of claim 6 a relative alignment in one or two substantially perpendicular directions of the first and second sub-modules is provided by their attachment structures and the relative position of the first and second sub-modules is controllable when assembling the conductor module and the housing. In a further substantially perpendicular direction the relative position of the second sub-module and its conductors can be directly determined with respect to the housing, not also being determined via the first sub-module, when accurate control of the position of the sub-modules with respect to the housing is (more) efficiently achievable and/or preferred. Advantageously, a relative displacement of the first and second sub-modules is allowed in direction the mating direction and/or a direction of assembly of the conductor into the housing.

The connector assembly of claim 7 facilitates fixing the position of at least one sub-module with respect to the housing. Advantageously, the retaining structure allows fixation in two or three mutually perpendicular directions. Providing the retaining structure as a portion of a conductor, e.g. a retaining barb formed by an extension of the conductor, allows increasing the fixation force of the retaining structure, since the conductor will generally be of a material which has mechanical properties different from that of the housing, e.g. a metal conductor and a plastic housing.

In the connector assembly of claim 8, electromagnetic coupling between adjacent conductors is predictable and usable for achieving particular signal transmission behaviour.

In particular, utilising broadside coupling may facilitate high signal frequency transmission with differential signalling.

In the connector assembly of claim 9, the lead frame of the first sub-module of a first conductor module may be different or, advantageously, substantially identical to the lead frame of the second sub-module of a second conductor module, and the lead frame of the second sub-module of the first conductor module may be different or, advantageously, substantially identical to the lead frame of the first sub-module of a second conductor module. The connector facilitates arranging conductors in a desired pattern or spacing, e.g. with a pattern repeating every second or third conductor module, while the conductor modules may be robust and may be mounted with reliable positioning into the housing.

In the connector assembly of claim 10, lead portions of conductors of a conductor module may be arranged in separate sub-modules whereas the contacts are arranged in a row or column of at least partially overlapping contacts. This facilitates designing a housing and mating with a counterconnector assembly. It further facilitates integration with existing counterconnector assemblies which generally have contacts arranged in rows and/or columns.

In the connector assembly of claim 11, the protruding portion of the overmoulding material increases robustness of the conductor towards the at least one contact. The protruding portion may also provide a stand-off for mounting the connector assembly. A possibly more important effect of the protruding portion of the overmoulding material is to increase the amount of dielectric material close to the conductor to improve impedance matching between the portions of the conductor inside of the sub-module (at the overmoulded portion of the lead portion) and outside of the sub-module (at the contact and a possible exposed portion of the lead portion), respectively. Advantageously, the protruding portion of the overmoulding material is arranged substantially only at an outside of the conductor module, i.e. away from the other sub-module forming the conductor module, so as to reduce effects of the protruding overmoulding material portion on (one or more conductors in) the other adjacent sub-module.

For determining and/or maintaining the position of one or more conductors within the first and/or second sub-module during overmoulding the lead frame assembly, one or more tools may be used to hold the lead portion of that/those conductor(s). At the position(s) of such one or more tools, or by any other cause, a recess or hole in the overmoulding material may be formed. Such recess or hole may result in a varying impedance along the lead portion which may negatively affect properties of a signal transmitted through the conductor. In the connector assembly of claim 12 such effect on the impedance is reduced, since the recess or hole is filled at least partially with the corresponding protrusion of the adjacent sub-module.

The method of claim 13 facilitates manufacturing of a connector assembly and in particular achieving accurate true position of the lead portions and contacts of the connector assembly. Further, the conductor module may be tested prior to attaching the conductor assembly to the housing, reducing chances of defects in an assembled connector assembly.

In another aspect, the connector assembly of claim 14 is provided. In the connector assembly, the housing and the contact of the conductor comprise cooperating portions for preloading the contact to facilitate connection with the counterconnector by reducing the force required for mating the contact and a mating contact. The first stand-off structure may be a structure protruding from the first side wall. Due to the first stand-off structure, at least the contact portion of the contact beam, advantageously substantially the entire contact beam, is maintained separated from the first side wall of the cavity within which the contact is disposed in and between the preload position and the second position for receiving at least a portion of the mating contact of the counterconnector. This reduces or prevents hindrance or obstruction of the displacement of (at least the contact portion of) the contact beam between the preload position and the second position by friction between the contact beam and the side wall. Such friction may otherwise render the force required for mating high and/or unpredictable, which reduces user friendliness, and/or even cause damage to the contact and/or the housing of the connector assembly and/or counterconnector.

The first stand-off structure may also and/or further assist in positioning at least a portion of the contact beam of the contact correctly with respect to the preload structure of the housing, without interference between (at least the contact portion of) the contact beam and the first side wall.

The connector assembly may be particularly useful when the contact is a receptacle contact or a hermaphroditic contact.

The connector assembly of claim 15 facilitates inserting the contact into the cavity and arranging and maintaining the contact in a desired position with respect to stand-off structure.

The connector assembly of claim 16 provides increased robustness for the preload structure and the stand-off structure. The connector assembly also facilitates arranging at least a portion of the contact in the desired preload position.

The connector assembly of claim 17 allows reducing friction between the contact and the first stand-off structure, and/or the second stand-off structure when present, during displacement between the preload position and the second position.

The position of the contact relative to the first stand-off structure, and/or the second stand-off structure when present, may be reliably determined by directing, e.g. bending, a portion of the contact The contact may comprise at least two contact beams which are arranged at an angle to each other different from opposite, e.g. two contact beams perpendicular to each other, and which each have a contact portion. The cavity may comprise at least two side walls, each extending substantially perpendicular to at least one of the two contact beams and comprising stand-off structures configured to cooperate with at least a portion of the contact to provide and maintain a separation between at least the contact portions of the at least two contact beams and the side wall extending perpendicular to the respective contact beams.

BRIEF DESCRIPTION OF THE DRAWINGS

These and further aspects will hereafter be more fully explained with reference to the drawings showing an embodiment of the invention by way of example.

Figure 1:
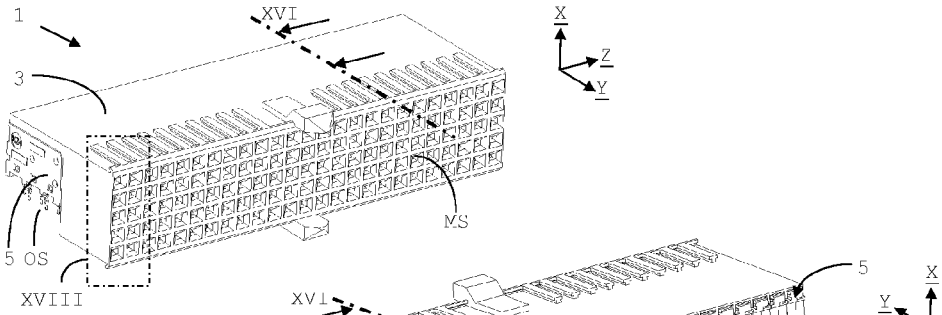
FIGS. 1-3 are various perspective views of a connector assembly.

It is noted that the drawings are schematic, not necessarily to scale and that details that are not required for understanding the present invention may have been omitted.

In several figures (e.g. FIGS. 1-3) (the positive portion of) a Cartesian coordinate system (X, Y, Z) is indicated to which coordinate system reference is made for explanation purposes only and which should be considered non-limiting; such references relate only to the embodiments as oriented in the drawings, unless otherwise specified. Further, elements that are at least substantially identical or that perform an at least substantially identical function are denoted by the same numeral.

DETAILED DESCRIPTION OF EMBODIMENTS

Figure 2:
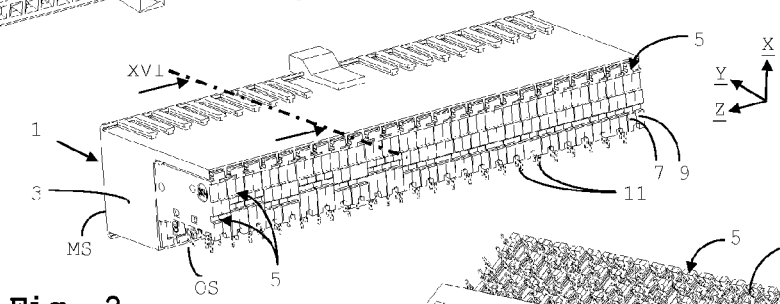
Figure 3:
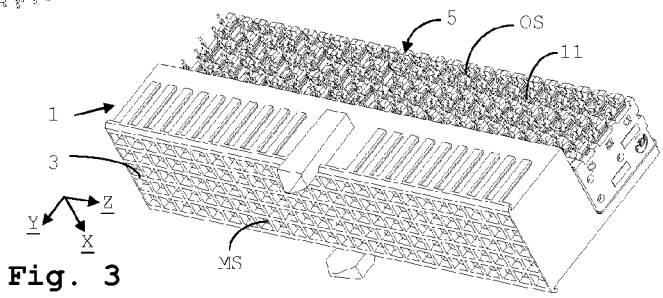
Figure 4:
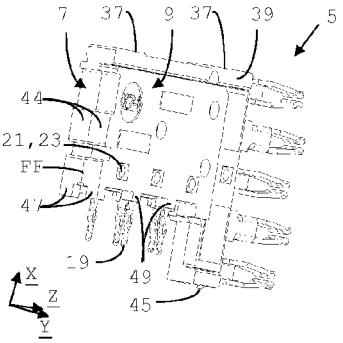
FIG. 4 is a perspective view of a conductor module comprising two sub-modules.

FIGS. 1-3 show a connector assembly 1 comprising a housing 3 and a plurality of conductor modules 5. The connector housing 3 is shown in more detail in FIGS. 8-15. A conductor module 5 is shown in more detail in FIGS. 4-7. Details of the connector assembly are shown in FIGS. 16-19.

The connector assembly 1 is a right-angle connector configured for connecting with a mating counterconnector (not shown) in a mating direction along the Y-direction at a mating side MS of the connector assembly, and for connecting to a further object such as a circuit board (not shown) in the X-direction at an object side OS.

In the shown connector assembly 1, each conductor module 5 comprises a first sub-module 7 and a second sub-module 9. The conductor modules 5 comprise conductors 11 through which signals are to be transmitted. The first and second sub-modules 7, 9 each comprise an overmoulded lead frame assembly 13, 15 comprising a plurality of conductors 11. The conductors 11 have a lead portion (not shown) extending between a first contact 17, here having two opposed contact beams 18, and a second contact 19, here being eye-of-the-needle press fit contacts for circuit board mounting, on opposite ends of the lead portion. A portion of the lead portions is overmoulded with an overmoulding material 17 to form the overmoulded lead frame assemblies. The conductor modules 5, and the sub-modules 7, 9 are substantially plane and when assembled into the connector assembly extend in the X,Y-plane, with Z normal to the plane of extension of the (sub-) module 5, 7, 9. The sides of each of the first and second sub-modules 7, 9 which are to face each other in the assembled conductor module 5 are indicated with "F". In the shown embodiment the sub-modules 7, 9 have substantially the same thickness in the Z-direction and a mid-plane of the assembled conductor module 5 corresponds to the sides F and is identified with "FF". The conductor modules 5 in the shown embodiment are asymmetric with respect to the plane FF.

The first and second sub-modules 7, 9, comprise cooperating attachment structures for attaching the first and second sub-modules 7, 9 together to form the conductor module 5. Here, the cooperating attachment structures comprise protrusions and recesses 23 on the first and second sub-modules 7, 9 which are configured to fit engage each other. The first sub-module 7 further comprises deformable protrusions 25 and the second sub-module 9 further comprises recesses 27 configured to fittingly receive the protrusions 25.

The first sub-module 7 comprises protruding rail portions or rib portions 29, 31 which here extend along a portion of an upper side 30 of the sub-module 7 (rib portion 29) and along a portion of a bottom side 32 of the sub-module 7, opposite the upper side (rib portion 29). The rib portions 29, 31 give the first sub-module a somewhat U-like shape in cross-section in an X,Z-plane and allow the second sub-module 9 to fit at least partially within and be enveloped by the first sub-module 7, as best visible in FIG. 4.

The first and second sub-modules 7, 9 further comprise recesses 33 which are the result of the overmoulding process, wherein structures in the used mould(s) are used to fix the position of the conductors during overmoulding. Each sub-module 7, 9 further comprises protrusions 35 configured and positioned to be received in, and at least partially fill, the recesses 33 of the sub-module 9, 7 to be placed adjacent to it for assembling the conductor module 5 from the first and second sub-modules 7, 9.

The first and second sub-modules 7, 9 are formed such that the second sub-module 9 fits closely between the rib portions 29, 31, providing a relative position determination of the first and second sub-modules 7, 9 in the X-direction. At least the recesses 23, 27 are configured to receive the corresponding protrusions 21, 25 with a substantially tight fit in the X-direction. The recesses 33 and protrusions 35 may be loose-fitting or also tight-fitting in the X-direction. Thus, the alignment and relative position of the first and second sub-modules 7, 9 in the X-direction are fixed. However, in the present embodiment the recesses 23, 27, 33 and protrusions 25, 29, 35 allow some relative displacement or "play" in the Y-direction. The substantially complementary shape of the sides F of the first and second sub-modules 7, 9 which are to face each other in the assembled conductor module 5 provides a relative position determination of the sub-modules 7, 9 in the Z-direction. Outside faces of the conductor module 5 in the Z-direction are formed for assembling the connector assembly 1, here allowing adjacent conductor modules 5 to slide with respect to each other in at least the Y-direction into the housing 3.

The overmoulding material of the first sub-assembly 7 is formed with plural alignment surfaces 37, 39, 41 and an interference structure 43, to be discussed below. One or more abutment structures 44 or the like may be provided as well. One of the conductors 11 of the first sub-assembly 7 comprises an extending portion forming a barb 45.

In the shown embodiment, both sub-modules 7, 9 comprise stand-off structures 47 at the object side OS for facilitating mounting the (modules 5, 7, 9 of) the connector 1 to a further object, e.g. for soldering and/or coolant flow.

Figure 5:
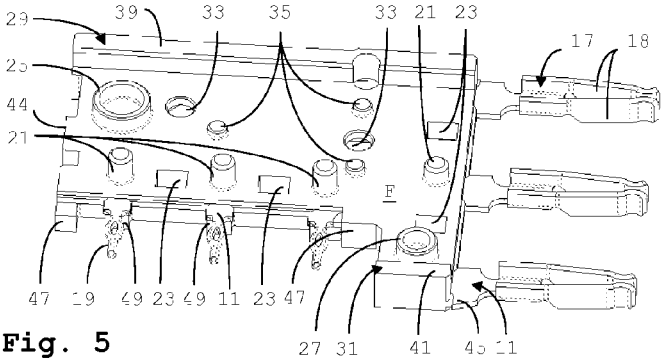
FIG. 5 is a perspective view of a first sub-module of the conductor module of FIG. 4.
Figure 6:
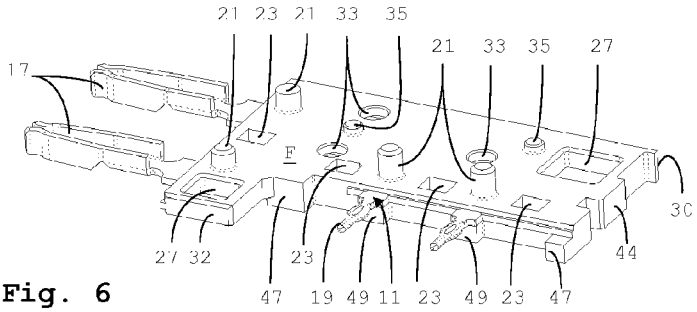
FIG. 6 is a perspective view of a second sub-module of the conductor module of FIG. 4.
Figure 7:
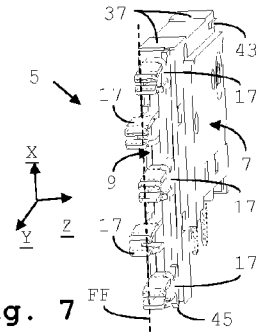
FIG. 7 shows the conductor module of FIG. 4 from a different viewing angle.

As best visible in FIGS. 5-7, the conductors 11 of the sub-modules 7, 9 are arranged within the overmoulding material offset from a mid-plane of the sub-module 7, 9 and offset from the mid-plane FF of the conductor module 5 as a whole. However, in the shown embodiment the contacts 17 of the conductors are formed such that all contact beams 18 at least partially overlap the mid-plane FF (see FIG. 7). In the present embodiment the contacts 19 do not overlap to facilitate routing of signal traces in a circuit board connected at the object side OS.

In the first and second sub-modules 7, 9, the contacts 19 define a contact mating direction in the X-direction. At each contact 19 a portion 49 of the overmoulding material protrudes adjacent the conductor 11 along the contact mating direction towards the contact 19. In the shown embodiment the protruding portions 49 are only arranged at a side of the conductor 11 oriented away from the side F and thus at an outside of the assembled conductor module 5 and away from the adjacent sub-module 9, 7 within the assembled conductor module 5.

Figure 8:
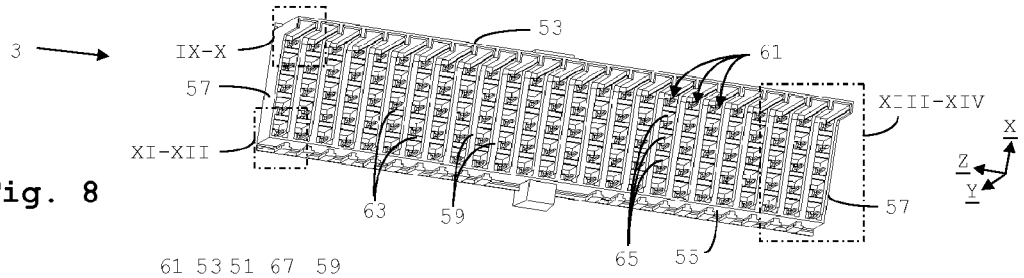
FIG. 8 is a perspective view of the connector housing of the connector assembly of FIGS. 1-3.
Figure 9:
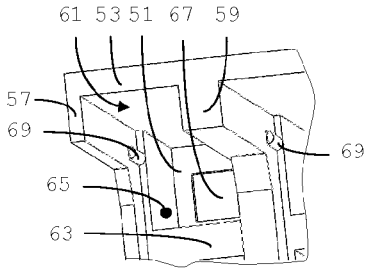
FIGS. 9-10 show detail IX-X of FIG. 8.
Figure 10:
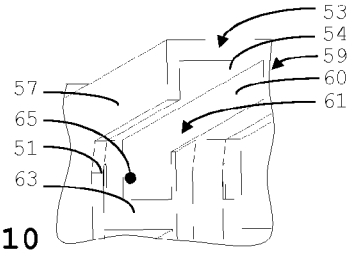
Figure 11:
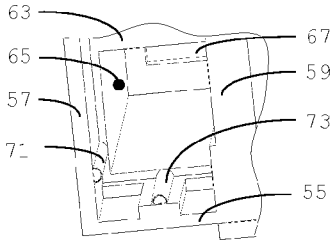
FIGS. 11-12 show detail XI-XII of FIG. 8.
Figure 12:
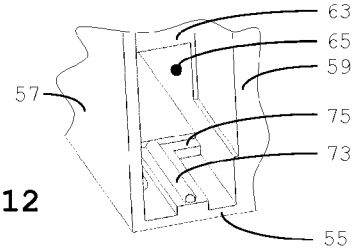
Figure 13:
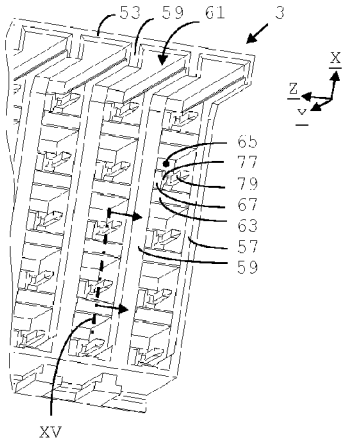
FIGS. 13-14 show detail XIII-XIV of FIG. 8.
Figure 14:
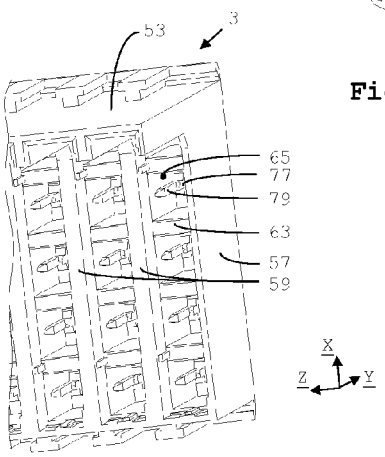
Figure 15:
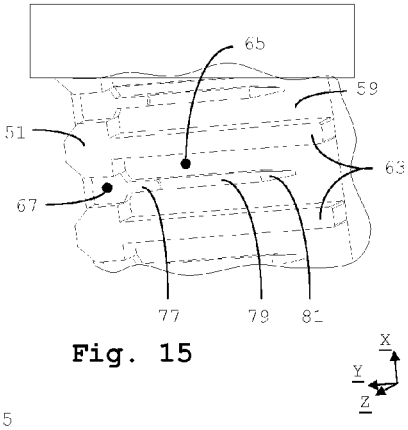
FIG. 15 is a partial cross-section view of detail XV of FIG. 13.

FIG. 8 shows the housing 3 of the connector assembly 1 of FIGS. 1-3 without conductor modules. FIGS. 9-10 show detail IX-X, FIGS. 11-12 show detail XI-XII and FIGS. 13-14 show detail XIII-XIV indicated in FIG. 8, with each detail is shown in perspective from two different angles. FIG. 15 is a cross-section view of detail XV indicated in FIG. 13.

The housing 3 comprises a front wall 51 at the mating side MS of the housing 3 extending in an X,Z-plane, a top wall with inner surface 54 and a bottom wall 55 extending substantially parallel to each other in a Y,Z-plane, and substantially parallel outside walls 57 extending in a X,Y-plane. A plurality of walls 59 substantially parallel in a X,Y-plane form side walls 59 having inner surfaces 60 and dividing the housing 3 into compartments 61 which are arranged adjacent in the Z-direction and are configured for receiving and holding a conductor module 5 oriented in an X,Y-plane (cf. FIG. 2). Each compartment 61 comprises further partition walls 63 substantially parallel in an a Y,Z-plane. The walls 59, 63 define a plurality of adjacent cavities 65 for accommodating contacts 17 of the conductor modules 5; apertures 67 in the front wall 51 grant access to cavities 65 and the contacts 17 disposed therein for mating and connecting the connector assembly 1 with a counterconnector along the Y-direction.

Each compartment 61 comprises interference structures 69, 71, 73. Upon insertion of the conductor module 5 into the housing 3, the interference structures 69, 71, 73 of the housing and the interference structure 43 of the conductor module 5 interact between the first sub-module 7 and the housing 3 and serve to force the alignment surfaces 37, 39, 41 of (the first sub-module 7 of) the conductor module 5 on the opposite side of it against the inner surface of the top wall 53 and the inner surface of the side wall 59, respectively, of the compartment 61 in the positive X- and negative Z-directions such that the position of (the first sub-module 7 of) the conductor module 5 is well defined in these directions (+X and −Z) with respect to the housing 3. The position of the second sub-module 9 with respect to the housing 3 is defined by the relative positions of both sub-modules 7, 9.

As best seen in FIG. 2, and in FIGS. 18 and 19 to be discussed later, conductor modules 5 may be provided which are mirror images of each other with respect to the arrangement and orientation of the conductors 11 within the conductor modules 5, e.g. relative to a mid-plane FF. In the shown embodiment, the compartments 61, the interference structures 43, 69, 71, 73 and the alignment surfaces 37, 39, 41, of the housing 3 and the conductor modules 5 are substantially identical such that the alignment and tolerances therefor all act in the same direction, improving overall reliability of the true position of the contacts 17, 19 of all conductor modules 5 and thus the entire connector assembly 1.

The positions of each sub-module 7, 9 with respect to the housing 3 in the Y-direction are determined in the shown embodiment by inserting each sub-module 7, 9 into the cavities 61 to a desired position, e.g. by pressing with a proper seating tool against abutment structures 44 of the sub-modules 7, 9 until one or more alignment surfaces (not shown) on a front side of the (sub-) modules 7, 9 abut one or more corresponding alignment surfaces (not shown) in the compartment 61. To fix the position of the conductor module 5 to the housing, and in particular in the Y-direction corresponding to the mating direction and mating forces, the retaining barb 45 may engage a portion 75. Friction between the recesses 23, 27, 33 and protrusions 25, 29, 35 may fix the relative Y-position of the first and second sub-modules 7, 9 and the relative Y-position of the second sub-module 9 and the housing 3. The barb 45 may also force the conductor module 5 in the (+) X-direction against the top wall 53 and thus also act as interference structure for alignment in the X-direction. A sharp barb 45 may prevent sideways motion in the Z-direction. Since the barb 45 extends from a conductor 11, bending or deformation of the sub-module 7 due to a force off-centered from a symmetry plane of the sub-module is prevented.

Figure 16:
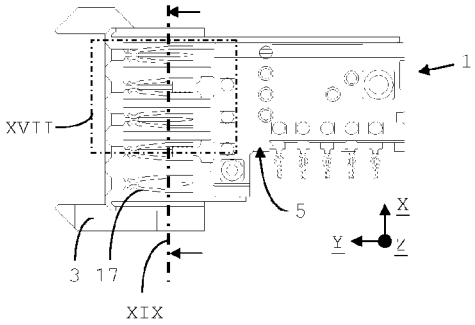
FIG. 16 is a cross-section view of the connector assembly of FIGS. 1-3 as indicated in FIGS. 1-2.
Figure 17:
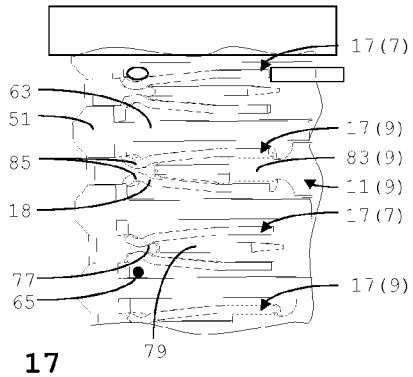
FIG. 17 is a cross-section view of detail XVII of FIG. 16.

On each side wall 57, 59 within each cavity 65, a preload structure 77 and a stand-off structure or abutment rib 79 with a lead-in portion 81 are provided, which protrude from that side wall 57, 59 and which are best visible in FIG. 15, showing cross-section detail XV of FIG. 13, and in FIG. 17, showing detail XVII of the cross-section view of FIG. 16.

When assembling the connector assembly 1, the conductor modules 5 are assembled from sub-modules 7, 9 and the assembled conductor modules 5 are inserted in the compartments 61 along the Y-direction, and such that the contacts 17 are disposed within the cavities 65 (FIGS. 1-3 and 16-19). FIG. 16 is a cross-section through the mid-plane FF of a conductor module 5, hence different portions of the column of contacts 17 of the different sub-modules 7, 9 are visible in FIG. 17, as indicated with the different respective reference symbols in parentheses 17 (7) and 17(9), respectively (see also FIG. 7).

The contact beams 18 of the contacts 17 are interconnected with the lead portion of the conductor 11 with a support portion 83. Each contact beams comprise a contact portion 85 for contacting a mating contact of a counterconnector (not shown). When disposed in final position within the cavity 65 the contact portions 85 engage a preload structure 77 which supports the contact beams 18 into a preload position with (at least the contact portions 85 of) the contact beams 18 somewhat separated to facilitate inserting a mating contact, such as male pin, between them.

The contact beams 18 are arranged substantially perpendicular the side walls 57, 59 of the cavities 65. The support portions 83 of each contact 17 extend substantially perpendicular to the contact beams 18 and at least partially substantially parallel the side walls 57, 59. The support portions 83 are configured to abut a stand-off structure 79. As may be derived from FIGS. 18 and 19, in cooperation with that stand-off structure 79, the position of the contact beams 18 within the cavity 65 is established and the contact beams 18 are kept and maintained separated from the side wall 57, 59 at the side of the support portion 83 both in the preload position and in a position when a mating contact of a counterconnector is received between the contact beams 18. In order to prevent the contact beams 18 from coming into contact with the side wall 57, 59 opposite the support portion 83, the contacts 17 may be bent outward in the Z-direction at an angle to the X,Y-plane, i.e. away from the sides F of the sub-modules 7,9 and/or the mid-plane FF of the conductor module 5 at some instance prior to insertion of the conductor module 5 into the housing 3. Contacts 17 of each sub-module may be bent to opposite angles, outward of the mid-plane FF. Such deflection to an angle in Z ensures that the support portions 83 be oriented towards and be in contact with the nearest stand-off structure 79 when positioned in the housing 3, such that the stand-off structure may assist establishing the position of the contact 17 within the cavity 65. The lead-in portions 81 of the stand-off structures 79 facilitate insertion of the contacts 17 into the cavities 65.

Figure 18:
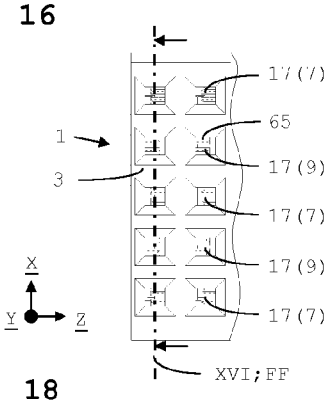
FIG. 18 is a partial front view of the connector assembly of FIGS. 1-3 as indicated in FIGS. 1 and 16.
Figure 19:
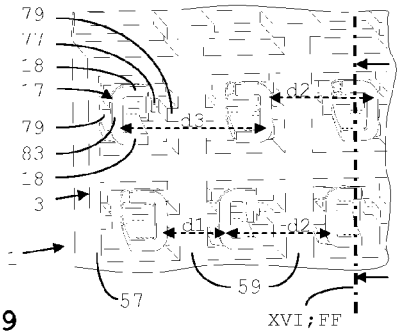
FIG. 19 is a partial cross-section view of the connector assembly of FIGS. 1-3 as indicated in FIG. 16.

As best seen in FIGS. 2, 18 and 19, conductor modules 5 may be provided which are mirror images of each other with respect to the arrangement and orientation of the conductors 11 within the conductor modules 5, e.g. relative to a mid-plane FF. This may be used to achieve desired (relative) spatial arrangement of the conductors 11 in adjacent over-moulded lead frame assemblies, e.g. for reasons of signal integrity and/or cross-talk coupling. Broad-side coupling of adjacent pair of conductors may increased or decreased as desired, as indicated with distances d1, d2 and d3 in FIG. 19. Within one conductor module 5, the lead portions of the conductors 11 in adjacent sub-modules 7, 9 may be formed such that one or more portions of one or more conductors 11 in adjacent sub-modules 7, 9 are arranged adjacent and parallel to each other, such that said one or more portions overlap when seen along the Z-direction, e.g. to increase broadside coupling of these conductor portions.

The invention is not restricted to the above described embodiment which can be varied in a number of ways within the scope of the claims. For instance a conductor module may comprise one or more further sub-modules, e.g. on either side of the first sub-module.

The connector assembly may have a different shape, e.g. be a straight connector, a mezzanine connector, or have another angle between opposite contacts than substantially 0 degrees (straight connector) and 90 degrees (right angle connector as shown).

The connector assembly may comprise more or less conductor modules, conductor modules with more, less or differently arranged conductors, conductor modules which do not comprise sub-modules, one or more spacer modules without conductors, etc.

Contacts of one or more conductor modules may be of any desired type and/or have any desired shape.

It should be noted that in the claims, the word "comprising" does not exclude other elements or steps, and the indefinite article "a" or "an" does not exclude a plurality.

Elements and aspects discussed for or in relation with a particular embodiment may be suitably combined with elements and aspects of other embodiments, unless explicitly stated otherwise.

The invention claimed is:

1. A connector assembly, comprising a housing and at least one conductor module, wherein the housing defines a mating direction (Y) and mates to a counterconnector wherein the at least one conductor module comprises at least a first sub-module and a second sub-module, wherein the first and second sub-modules each comprise an overmoulded lead frame assembly comprising at least one conductor having a lead portion extending between a first contact and a second contact on opposite ends of the lead portion, wherein at least a portion of the lead portion is overmoulded with an overmoulding material, wherein the first and second sub-modules each comprise cooperating attachment structures for attaching the first and second sub-modules each together to form the conductor module wherein the at least one conductor module is at least partially received in the housing wherein the housing and the first sub-module comprise cooperating positioning structures for positioning the at least one conductor module into the housing such that the position of the second sub-module with respect to the housing is determined by the position of the first sub-module with respect to the housing in at least a first direction (X; Z) substantially perpendicular to the mating direction.

2. The connector assembly of claim 1, wherein the first sub-module is configured to at least partially envelop the second sub-module.

3. The connector assembly of claim 1, wherein the cooperating positioning structures of the housing and the first sub-module comprise first cooperating alignment surfaces at one side of the conductor module and first cooperating interference structures at an opposite side of the conductor module, wherein the first cooperating interference structures are configured to force the first cooperating alignment surfaces of the housing and the first sub-module into close contact with each other to define the position of the conductor module with respect to the housing in the first direction (Z) substantially perpendicular to the mating direction (Y).

4. The connector assembly of claim 1, wherein the cooperating positioning structures of the housing and the first sub-module comprise second cooperating alignment surfaces at one side of the at least one conductor module and second cooperating interference structures at an opposite side of the at least one conductor module, wherein the second cooperating interference structures are configured to force the second cooperating alignment surfaces of the housing and the first sub-module into close contact with each other to define the position of the at least one conductor module with respect to the housing in a second direction (X) substantially perpendicular to the mating direction (Y).

5. The connector assembly of claim 3, wherein the connector assembly comprises a plurality of conductor modules arranged adjacent each other, each of said plurality of conductor modules comprising at least a first and a second sub-module attached together to form the respective conductor module, wherein the housing and the first sub-module of each of said plurality of conductor modules comprise at least first cooperating alignment surfaces at one side of the respective conductor module and first cooperating interference structures at an opposite side of the respective conductor module, wherein the first cooperating interference structures of the housing and the respective conductor module are configured to force the first cooperating alignment surfaces of the housing and the respective conductor module into close contact with each other to define the position of the respective conductor module with respect to the housing in the first direction (Z).

6. The connector assembly of claim 1, wherein the cooperating attachment structures of the first sub-module and the second sub-module comprise cooperating alignment structures configured to determine a relative alignment of the first sub-module and second sub-modules in at most two directions (X, Z) which are substantially perpendicular to the mating direction (Y) , and to allow a relative displacement of the first and second sub-modules in at least one direction (Y) substantially perpendicular to one or the two directions.

7. The connector assembly of claim 1, wherein at least one conductor of at least one of the first and second sub-modules comprises a retaining structure for engaging at least a portion of the housing to fix at least the at least one sub-module to the housing.

8. The connector assembly of claim 1, wherein at least one conductor of the first sub-module and one conductor of the second sub-module of the at least one conductor module are arranged parallel to and adjacent each other along at least a portion of the respective lead portions.

9. The connector assembly of claim 1, wherein the connector assembly comprises a plurality of conductor modules arranged adjacent each other, each of the plurality of conductor modules being substantially plane and each having a midplane (FF) and wherein the relative orientation of the lead frame of the first sub-module and the lead frame of the second sub-module in at least two adjacent conductor modules are substantially mirror images of each other with respect to the midplane of the respective conductor modules.

10. The connector assembly of claim 1, wherein the at least one conductor module is substantially plane and has a midplane (FF) , and wherein at least the first contacts of the conductor (s) of the first and second sub-modules are formed to overlap at least partially the midplane.

11. The connector assembly of claim 1, wherein in at least one of the first and second sub-modules at least one contact of at least one of the conductors defines a contact mating direction (X) and wherein a portion of the overmoulding material protrudes adjacent the conductor along the contact mating direction towards the at least one contact such that more overmoulding material is provided towards an outside of the terminal module, at a side of the conductor oriented away from the adjacent sub-module within the conductor module than at a side of the conductor oriented towards the adjacent sub-module within the conductor module.

12. The connector assembly of claim 1, wherein at least one of the first and second sub-modules of the at least one conductor module comprises at least one recess in the overmoulding material and wherein the at least one conductor module comprises an adjacent sub-module comprising at least one protrusion configured to at least partially fill the at least one recess.

13. A method of manufacturing a connector assembly, comprising the steps of:

providing a housing defining a mating direction (Y) that mates to a counterconnector;

providing a first and a second overmoulded lead frame assembly comprising at least one conductor having a lead portion extending between a first contact and a second contact on opposite ends of the lead portion, wherein at least a portion of the lead portion is overmoulded with an overmoulding material, to form a first and a second sub-module;

providing the first and second sub-modules each with cooperating attachment structures for attaching the first and second sub-modules each together;

forming at least one conductor module from the first and second sub-modules;

forming the connector assembly by positioning the at least one conductor module into the housing such that the position of the second sub-module with respect to the housing is determined by the position of the first sub-module with respect to the housing in at least a first direction (X, Z) substantially perpendicular to the mating direction.

14. A connector assembly comprising a housing and at least one conductor having a contact disposed within a cavity in the housing, wherein the contact comprises at least one contact beam with a contact portion wherein the housing defines a mating direction (Y) for mating to a counterconnector, wherein the cavity is at least partially defined by a front wall which is arranged towards a mating side (MS), which extends substantially perpendicular to the mating direction and which is provided with an aperture providing access to the contact disposed within the cavity, wherein the cavity is further at least partially defined by a first side wall arranged perpendicular to the front wall and extending substantially in the mating direction, wherein at least one of the front wall and the first side wall comprises a first preload structure configured to cooperate with the contact beam to support the contact beam in a predetermined preload position, and wherein at least one of the front wall and the first side wall comprises a first stand-off structure configured to cooperate with at least a portion of the contact to provide and maintain a separation between at least the contact portion and the first side wall.

15. The connector assembly of claim 14, wherein at the first stand-off structures comprises a portion protruding from the side wall, e.g. a rib portion, with a lead-in portion.

16. The connector assembly of claim 14, wherein at least a portion of the first preload structure and the first stand-off structures are an integrated structure.

17. The connector assembly of claim 14 wherein the contact comprises a support portion, which support portion extends substantially perpendicular to the at least one contact beam and at least partially substantially parallel to at least a portion of the first side wall and which support portion is configured to abut and cooperate with the first stand-off structure.

18. The connector assembly of claim 1, wherein the cooperating attachment structures for attaching the first and second sub-modules each together to form the conductor module are configured to fit engage each other.

* * * * *